US005813075A

United States Patent [19]

Graur

[11] Patent Number: 5,813,075

[45] Date of Patent: Sep. 29, 1998

[54] TOOTHBRUSH HAVING BI-DIRECTIONAL ROTATIONAL HEAD

[76] Inventor: Walter Graur, 387 Jefferson St., Brooklyn, N.Y. 11237

[21] Appl. No.: 744,968

[22] Filed: Nov. 7, 1996

Related U.S. Application Data

[60] Provisional application No. 60/007,617 Nov. 29, 1995.

[51] Int. Cl.[6] ..... A46B 13/08

[52] U.S. Cl. ..... 15/22.1; 15/26; 74/99 A

[58] Field of Search ..... 15/22.1, 22.2, 15/23, 25, 26, 28; 74/99 A

[56] References Cited

U.S. PATENT DOCUMENTS

| | | | |
|---|---|---|---|
| 622,948 | 4/1899 | Gill | 15/26 |
| 1,226,482 | 5/1917 | Dossey | 15/26 |
| 1,256,288 | 2/1918 | Barnes et al. | 15/26 |
| 1,824,967 | 9/1931 | Seelig | 15/26 |
| 2,095,581 | 10/1937 | White | 15/26 |
| 4,763,372 | 8/1988 | Gougeon | 15/26 |

*Primary Examiner*—Terrence Till
*Attorney, Agent, or Firm*—Charles E. Temko

[57] ABSTRACT

A hand rotating type toothbrush having provision for rotation in first and second rotational directions using separate manually actuated slides. The shaft supporting the head is formed integrally with an axially aligned torsion bar which returns the head to neutral position. A first slide member provides for rotation in a first direction. A second slide member provides for rotation in a second direction, each slide member providing 180 degrees of rotation. Preferably, the entire device is formed from synthetic resinous materials for low cost of production and convenience in maintaining sanitary conditions. The shaft is selectively fixed at an inner end thereof to the handle by catch or detent means, thus maintaining the device in selectively assembled condition.

5 Claims, 3 Drawing Sheets

TOOTHBRUSH HAVING BI-DIRECTIONAL ROTATIONAL HEAD

Reference is made to my provisional application, Ser. No. 60/007,617, filed Nov. 29, 1995, now abandoned.

BACKGROUND OF THE INVENTION

This invention relates generally to the field of dental instruments, particularly toothbrushes of a type in which a head element holding the bristles at a free end thereof is supported upon a shaft capable of rotational movement relative to a handle, the movement being controlled by a sliding member actuated by the thumb of a user. Provision is made for the return of the head supporting the bristles to a neutral position when pressure on the sliding member is relaxed.

This art is highly developed, commencing from around the turn of the century. While devices of this type are very useful, prior art constructions have tended to be quite complex, difficult and/or expensive to manufacture, and difficult to maintain in sanitary condition after use. Part of the problem stems from the use of metallic components which are not readily disassembled by the user into individual pieces. The remainder stems from clumsy designs which shorten the life of the moving parts, causing the device to be discarded after a relatively short period of utility.

Other disadvantages present in prior art devices lie in the difficult degree of manual manipulation necessary to effect rotation of the bristled head. Several devices require two handed operation. Others require considerable manual force to overcome the resilient component of the device.

SUMMARY OF THE INVENTION

Briefly stated, the invention contemplates the provision of an improved device of the type described in which the above-mentioned disadvantages have been eliminated, or at least substantially ameliorated. To this end, the device is formed of a relatively small number of synthetic resinous parts which are readily disassembled by the user for periodic cleaning. The brush located at the free end of the shaft is capable of rotational oscillation in either of two directions using a pair of selectively operable slide elements, one for each direction, to rotate the shaft relative to the handle against the action of a resilient torsion bar which forms an inner part of the shaft. A pair of tracks are provided along another part of the shaft, each selectively engageable by a separate slide member operated by the thumb of the user. The slide members are in disengaged condition relative to respective tracks when the torsion bar is in unstressed condition, permitting the shaft to be removed with respect to the handle by manually disengaging a detent which anchors the inner end of the shaft relative to the handle element. In the preferred form, only four injection molded parts are required to form the entire device.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 1:
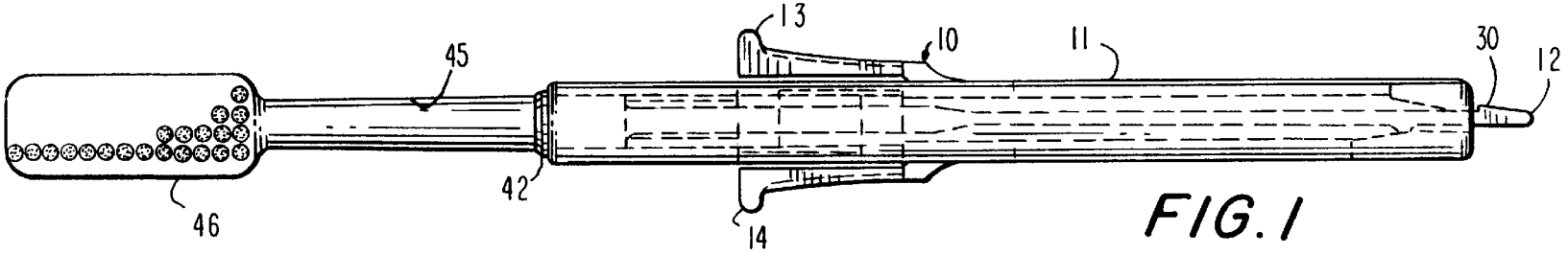
FIG. 1 is a top plan view of an embodiment of the invention.
Figure 3:
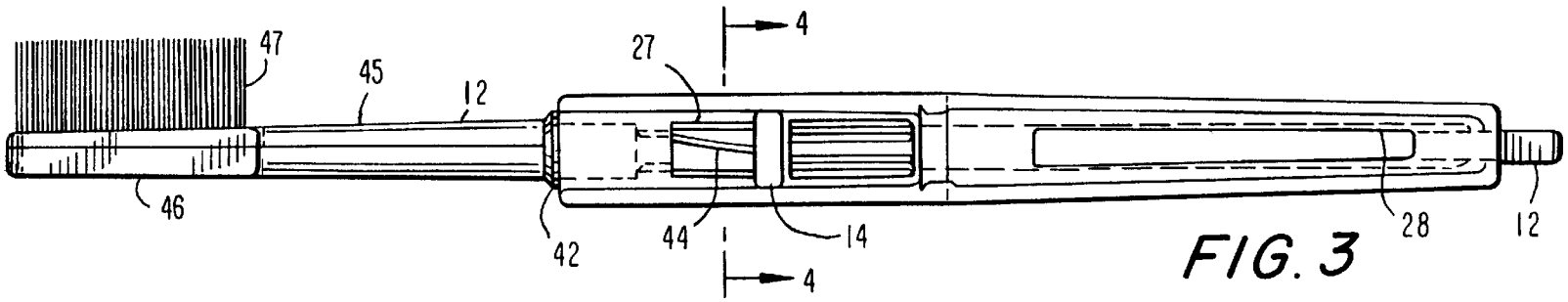
FIG. 3 is a side elevational view thereof.
Figure 4:
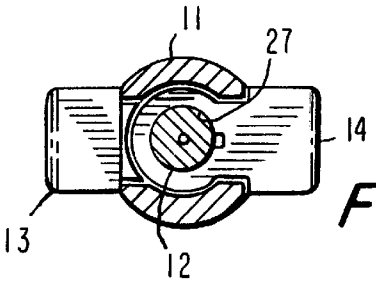
FIG. 4 is an end elevational view as seen from the left-hand portion of FIG. 3.
Figure 2:
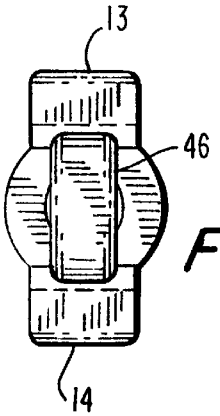
FIG. 2 is an end elevational view as seen from the left-hand portion of FIG. 1.
Figure 5:
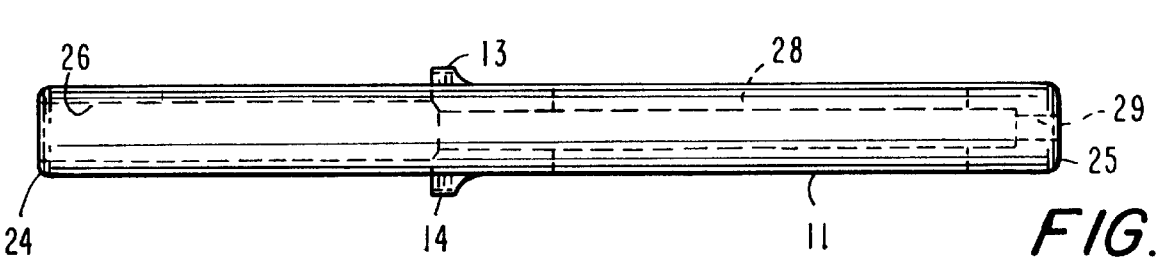
FIG. 5 is a top plan view of a handle element in detached condition.
Figure 6:
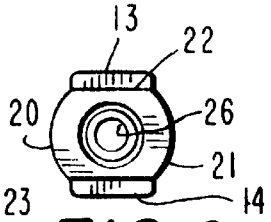
FIG. 6 is an end elevational view as seen from the left-hand portion of FIG. 5.
Figure 7:
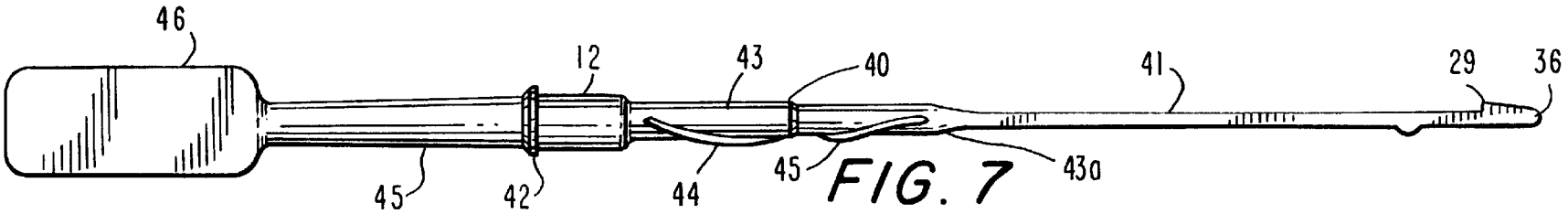
FIG. 7 is a top plan view of a shaft element.
Figure 8:
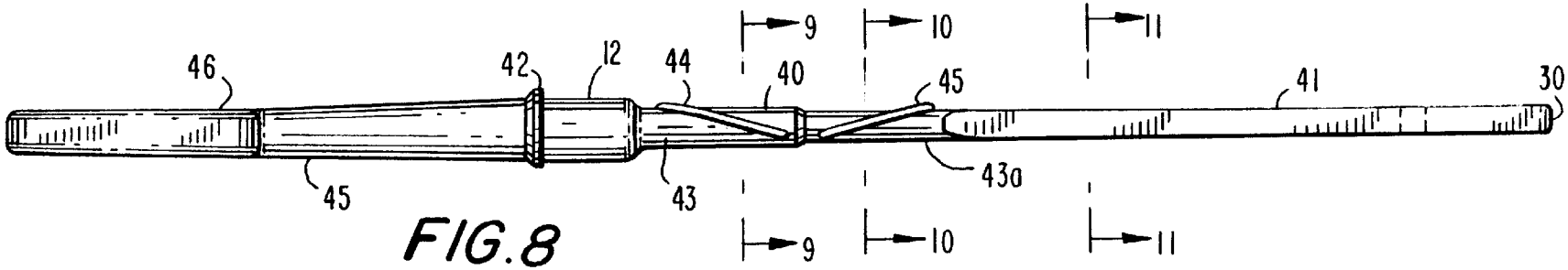
FIG. 8 is a side elevational view of the shaft element of FIG. 7.
Figure 11:
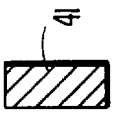
FIG. 11 is a transverse sectional view as seen from the plane 11—11 in FIG. 8.
Figure 10:
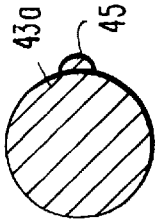
FIG. 10 is a transverse sectional view as seen from the plane 10—10 in FIG. 8.
Figure 9:
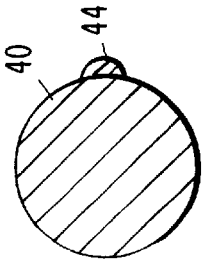
FIG. 9 is a transverse sectional view as seen from the plane 9—9 in FIG. 8.
Figure 12:
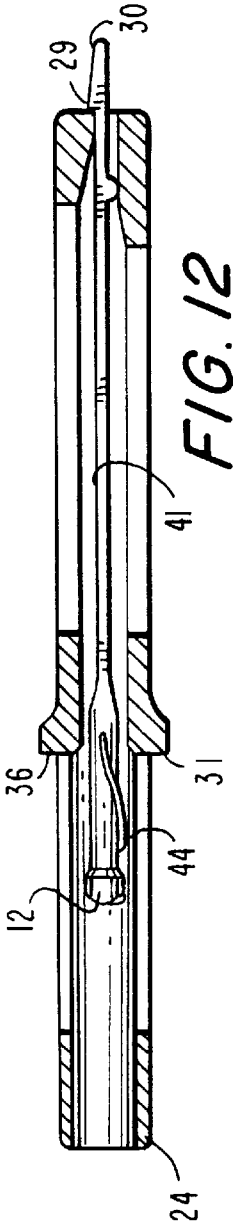
FIG. 12 is a fragmentary longitudinal sectional view of the handle element with the shaft element engaged therewith.

In accordance with the invention, the device, generally indicated by reference character 10, comprises broadly: a handle element 11, a shaft element 12, and first and second manually manipulated slide elements 13 and 14. Preferably, all of these elements are formed as injection moldings from synthetic resinous material, particularly, polypropylene.

The handle element 11 is of cylindrical configuration, and is bounded by first and second curved longitudinal surfaces 20 and 21, first and second planar longitudinal surfaces 22 and 23, and first and second end surfaces 24 and 25. Extending from the first end surface 24 is an axially aligned bore 26 communicating with a pair of upper slots 27 and a pair of lower slots 28. The bore 26 terminates in an end opening 29. Positioned axially to engage the end opening 29 of the shaft element 12 is a catch 30 which maintains the shaft element 12 in position, and prevents relative rotation. On the outer surfaces 22 and 23 are a pair of slide stops 31 which selectively engage the slide elements 13 and 14.

The shaft element 12 is preferably also a unitary molding, and includes a cylindrical member 40. A positioning bead 42 engages the end surface 24 when the device is assembled. Outer surfaces 43 and 43*a* are provided with a pair of spiral track members 44 and 45 which terminate to permit the slide elements 13 and 14 to be disengaged therewith upon disengagement of the catch 30 with the end surface 25, when the device is disassembled for cleaning.

An exposed segment 45 may be of tapered configuration and terminates in a planar bristle retaining portion 46 having suitable bristles 47 arranged in desired pattern.

Figure 14:
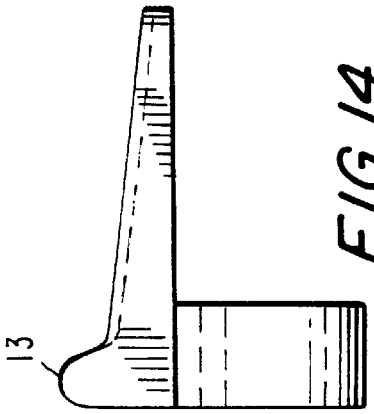
FIG. 14 is a top plan view of the slide element of FIG. 13.
Figure 15:
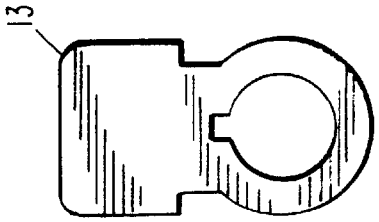
FIG. 15 is an end elevational view of the slide element.
Figure 13:
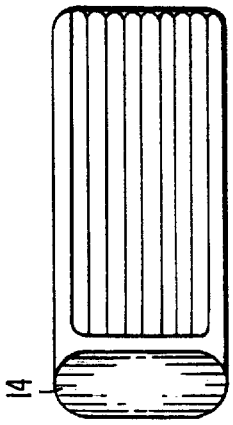
FIG. 13 is a side elevational view of a slide element.

The slide elements 13 and 14 (FIGS. 13–15) are positioned in tongue and groove engagement within the upper slots 27 and engage corresponding track members 44 and 45 at the open ends thereof. Each of the slides is operated independently using the thumb of a user to obtain rotational movement in the desired direction in known manner. Again, they are formed as synthetic resinous moldings to include a manually engageable member 50 bounded by longitudinal side surfaces 51 and 52, a thumb engaging surface 54 and track engaging projection 55.

As with prior art devices, a limited degree of rotation is initiated by moving one or the other of the slide elements longitudinally along the handle, this movement being imparted by the thumb of the user. This will result in rotation in the desired direction of up to 180 degrees, and upon release, the torsion bar segment 41 of the shaft element 12 will return the bead 42 to neutral position.

Periodically the device may be disassembled for total cleaning by disconnecting the shaft 12 from the handle element 11, this being accomplished by disengaging the catch 30. It will be observed that when the slide elements 13 and 14 are in manually disengaged condition, they are also essentially free of engagement with the corresponding track members 44 such that the shaft element may be removed by merely longitudinally pulling the shaft element relative to the handle element, rotating the shaft slightly to accommodate the track 45.

I wish it to be understood that I do not consider the invention to be limited to the precise details of structure shown and set forth in the specification, for obvious modifications will occur to those skilled in the art to which the invention pertains.

I claim:

1. A toothbrush comprising: a supporting shaft having a principal axis, a handle enclosing said shaft, said shaft having a bristled end thereon; said handle defining a cylindrical bore therein, said shaft being at least partially disposed within said bore and having a first end fixed to said handle at an end of said bore; a portion of said shaft disposed within said bore forming a torsion bar; a second portion of said shaft having at least one spiral track means; at least one manually operated slide carried by said handle selectively engaging said at least one of said track means for imparting rotational motion to said shaft in response to movement imparted to said slide parallel to said axis of said shaft; whereby, upon release of said slide, said torsion bar returns said shaft to a neutral position.

2. A toothbrush in accordance with claim 1, further comprising: first and second slides disposed upon opposite sides of said handle, first and second track means selectively engageable with corresponding slides, each slide imparting movement in a direction opposite to that imparted by the other slide.

3. The improvement in accordance with claim 2, in which said first and second tracks are of spiral configuration.

4. The improvement in accordance with claim 1, in which said first end is selectively fixed relative to said handle to permit removal of said shaft from said handle.

5. The improvement in accordance with claim 1, in which said toothbrush is formed substantially entirely from synthetic resinous materials.

* * * * *